US008104119B2

(12) United States Patent
Truex

(10) Patent No.: US 8,104,119 B2
(45) Date of Patent: Jan. 31, 2012

(54) HEADBOARD AND/OR FOOTBOARD COVER FOR BED

(76) Inventor: Dawn Truex, Middletown, NY (US)

( * ) Notice: Subject to any disclaimer, the term of this patent is extended or adjusted under 35 U.S.C. 154(b) by 0 days.

(21) Appl. No.: 12/799,928

(22) Filed: May 5, 2010

(65) Prior Publication Data

US 2010/0281615 A1 Nov. 11, 2010

Related U.S. Application Data

(60) Provisional application No. 61/215,512, filed on May 6, 2009.

(51) Int. Cl.
*A47G 9/00* (2006.01)

(52) U.S. Cl. ..... 5/482; 5/663; 5/53.1; 5/424

(58) Field of Classification Search ..... 5/488, 663, 5/424, 482, 53.1; 297/228.1, 228.11–228.13, 297/224, 219.1, 218.1–218.5
See application file for complete search history.

(56) References Cited

U.S. PATENT DOCUMENTS

| | | | | |
|---|---|---|---|---|
| 2,641,779 | A * | 6/1953 | Gill | 5/482 |
| 4,015,298 | A | 4/1977 | Scott | |
| 4,646,376 | A * | 3/1987 | Sulley | 5/482 |
| 4,821,349 | A * | 4/1989 | Cohen | 5/53.1 |
| 5,195,195 | A * | 3/1993 | Murray | 5/53.1 |
| 5,269,032 | A | 12/1993 | Flocks | |
| 5,911,654 | A | 6/1999 | Webb | |
| 6,079,778 | A * | 6/2000 | Lindberg | 297/228.11 |
| 6,447,059 | B1 * | 9/2002 | Jackson et al. | 297/228.12 |
| D468,565 | S | 1/2003 | Hazen et al. | |
| 6,539,564 | B1 * | 4/2003 | Hsia | 5/110 |
| 6,543,071 | B1 | 4/2003 | Lenner | |
| 6,796,614 | B1 | 9/2004 | Paul | |
| 7,000,984 | B1 * | 2/2006 | Ward | 297/228.12 |
| 7,024,709 | B2 * | 4/2006 | Moceri | 5/482 |
| 7,086,923 | B2 | 8/2006 | Karabees | |
| 7,155,761 | B2 | 1/2007 | DeRose | |
| 7,232,184 | B2 * | 6/2007 | Lawler | 297/228.1 |
| 2002/0074839 | A1 * | 6/2002 | Mahan | 297/228.1 |
| 2003/0127890 | A1 * | 7/2003 | Moon | 297/228.1 |
| 2005/0177940 | A1 * | 8/2005 | Moceri | 5/482 |
| 2006/0250003 | A1 * | 11/2006 | Baines et al. | 297/224 |
| 2007/0176474 | A1 * | 8/2007 | Miller et al. | 297/224 |
| 2010/0144237 | A1 * | 6/2010 | Wilkins | 297/217.1 |

OTHER PUBLICATIONS

Web pages from www.bejane.com/headboard—"Make your own upholstered Headboard".
Web pages from www.hgtv.com/decorating/upholstered-headboard/index.html—"Create an Upholstered Headboard".
Web pages from http://interiordec.about.com/cs/diybedroonn/ht/ht_uph_headboar.htm—"How to Make an Upholstered Headboard".

(Continued)

*Primary Examiner* — Robert G Santos
*Assistant Examiner* — Brittany Wilson
(74) *Attorney, Agent, or Firm* — Onofrio Law; Dara L. Onofrio, Esq.

(57) ABSTRACT

A headboard and/or footboard cover for a bed comprised of a back panel with at least one cinch cord and at least one tie back on each side of said back panel; a front panel with at least one cinch cord and at least one tie back on each side of the front panel; wherein the front panel has at least one pocket which may be filled with foam, feather, polyester or other like material; and a top cinch cord; wherein the top cinch cord connects the back and front panels.

10 Claims, 1 Drawing Sheet

OTHER PUBLICATIONS

Web pages from http://www.nextag.com/slipcover-headboard/search-html—slipcover headboard search results from NexTag.

Web pages from www.hgtv./decorating/headcomboard-slipcover/index.html—Headboard Slipcover.

* cited by examiner

HEADBOARD AND/OR FOOTBOARD COVER FOR BED

This application claims the benefit of U.S. provisional application No. 61/215,512 filed May 6, 2009, which is incorporated herein in its entirety by reference.

FIELD OF THE INVENTION

The present invention relates to a headboard and/or footboard cover for a bed and the related method for preparing an upholstered head or foot board cover. In particular, the cover is made of a front and back panel with cinch cords and tie backs to hold the cover in place and fit snuggly on the head or foot board.

BACKGROUND OF THE INVENTION

Each season individuals and home designers desire to change the look and feel of home interiors, especially the bedroom.

The invention provides a means for owners of wooden, metal, leather or other like material headboard frames, to transform them into an upholstered headboard that will not damage the underlying frame.

The prior art discloses references relating to the general disclosure of headboards and modifications thereto. Representative examples include: U.S. Pat. No. D 468,565 S which illustrates a headboard and or footboard for a bed; U.S. Pat. No. 7,155,761 B2 to DeRose discloses an interchangeable furniture system having faces with different appearances; U.S. Pat. No. 7,086,923 B2 to Karabees discloses a transformable toy furniture and room system including a plurality of slipcovers with indicia thereon; U.S. Pat. No. 6,796,614 to Paul discloses a modular furniture unit; and U.S. Pat. No. 4,015,298 to Scott discloses a tiltable headboard.

The prior art also disclosed headboard panels and covers. In particular, reference U.S. Pat. No. 6,543,071 to Lenner discloses interchangeable headboard panels with different finishes and themes. Lenner teaches furniture pieces that are interchangeable in contrast to the present invention which is actually a modification or transformation of the existing headboard by providing a novel cover.

U.S. Pat. No. 5,269,032 to Flocks discloses a portable and upholstered headboard. U.S. Pat. No. 4,821,349 to Cohen discloses a two-ply fabric covered headboard frame which maybe provided with a cushion and/or tufted surface. The Cohen patent is expired and along with Flock provides an actual headboard frame ensembles rather than a ready made headboard cover as disclosed by the present invention.

U.S. Pat. No. 5,911,654 to Webb discloses a cover and cushion ensemble for a hospital bed that converts the bed into a sofa or other covered seat. Webb provides a side rail cushion, headboard and footboard covers.

Various custom headboards and slipcovers are available commercially on the internet. Instructions on making custom headboards and slipcovers are found at the following representative sites: www.bejane.com/headboard; www.hgtv.com/decorating/upholstered-headboard/index.html; and http://interiordec.about.com/cs/diybedroom/ht/ht$_{13}$ uph$_{13}$ headboard.htm. In addition numerous books and references are known and available at Amazon.com, which relate to interior design and decorating including customized head board covers. In general, these customized headboards are difficult and time consuming to make.

Commercially available already made headboard slipcovers are typically integral pieces with the headboard and are quite expensive. Examples of such are found at http://www.nextag.com/slipcover-headboard/search-html. Commercially available headboard slipcovers with ties are found at www.hgtv./decorating/headcomboard-slipcover/index.html. However, this slipcover is limited in its use and is only for a flat rectangular headboard.

Unlike the present invention these patent references and products from the internet do not disclose a cover which is ready made for headboards and/or footboards on conventional beds. The invention cover includes cinch cords, which are pulled tight, so that the cover fits snuggly to the head board and/or footboard frame which may be a variety of shapes and sizes. Further the invention cover includes pockets for filling with pillows, foam, feathers or other filling to give an upholstered appearance to the head or foot board.

An advantage of the invention is in the provision of a fabric based cover for wooden or iron headboards (or footboards) including at least one cinch cord to snuggly fit the slip cover to the headboard, tie backs to secure and tighten the cover and pockets for filling with pillows, foam, feathers or other filing to give an upholstered appearance.

The invention is a ready made headboard or footboard cover for wooden, metal or leather frames, to provide a look and feel of an upholstered headboard. The headboard cover fits any size headboard and includes pockets for filing with pillows, foam, feathers or other filling to give an upholstered appearance.

There are two cover embodiments one for beds with posts and the other for beds without posts. The embodiment where the bed has posts includes cut outs in the cover for the posts. However, in both embodiments there is at least one cinch cord that is pulled tight to snuggly fit the slip cover to the headboard and tie backs to secure and tighten the cover to the frame.

A general objective of the invention is to provide headboard and/or footboard cover for a bed made of a front and back panel connected by a top cinch cord. Both the front and back panels have at least one cinch cord and at least one tie back on each side of the panel. The front panel has at least one pocket which may be filled with foam, feather, polyester or other like material. The cover is placed over the headboard frame. The tie backs from the front panel are tied to the back panel and the cinch cords are tightened to snuggly fit the cover on the headboard frame thus transforming it.

An object of the invention is to provide a cover which is universal in sizing to fit many different shaped headboards or footboards.

Another object of the invention is to provide a cover in standard sizes for king, caking, queen, full, single and day bed head board and foot boards An object of the invention is to provide at least one pocket on the front panel of the headboard cover for filling with pillows, foam, polyester, feathers and/or other filling. Multiple pockets, up to a maximum of fifty four can be included in the invention.

Yet another object of the invention is to permit orientation of the pillows or filling within the front panel in a variety of different arrangements.

Another object of the invention is to provide a cover made with a variety of materials including: faux suede, satin, silk, polyester, organic heavy cottons and hemp, preferably natural organic green materials.

A specific object of the invention is to provide an affordable, easy to utilize interior decorating item.

Another object of the invention is to improve the comfort of beds where individuals spend a significant percentage of time.

SUMMARY OF THE INVENTION

In the present invention, these purposes, as well as others which will be apparent, are achieved generally by providing a headboard and/or footboard cover for a bed comprised of a back panel with at least one cinch cord and at least one tie back on each side of said back panel; a front panel with at least one cinch cord and at least one tie back on each side of said front panel; wherein said front panel has at least one pocket which may be filled with foam, feather, polyester or other like material and a top cinch cord connects the back and front panels.

Other objects, features and advantages of the present invention will be apparent when the detailed description of the preferred embodiments of the invention are considered with reference to the drawings, which should be construed in an illustrative and not limiting sense.

DETAILED DESCRIPTION OF THE INVENTION

In accordance with the present invention a headboard and/or footboard cover for a bed is provided. As described in the accompanying drawings the structures of the invention are labeled as follows:

1—cinch cords;
2—pocket—filled with foam, feathers, polyester pillow, or preferably organic fiber;
3—tie backs;
4—back panel of the headboard cover;
5—front panel of the headboard cover;
6—cut outs for bed posts; and
7—top cinch cord.

Figure 1:
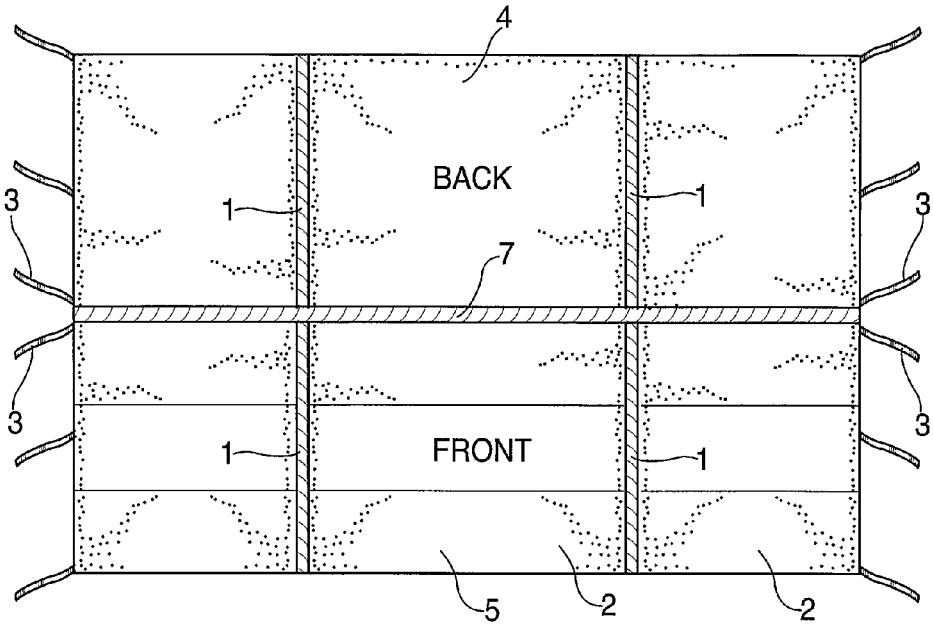
FIG. 1 is a top flat view of the general features of the invention.

In general, FIG. 1 represents the headboard and/or footboard cover for a bed comprised of a back panel 4 with at least one cinch cord 1 and at least one tie back 3 on each side of said back panel; a front panel 5 with at least one cinch cord 1 and at least one tie back 3 on each side of said front panel; wherein said front panel has at least one pocket 2 which may be filled with foam, feather, polyester pillow, or other like material; and a top cinch cord 7 that connects the back 4 and front 5 panels.

Figure 2:
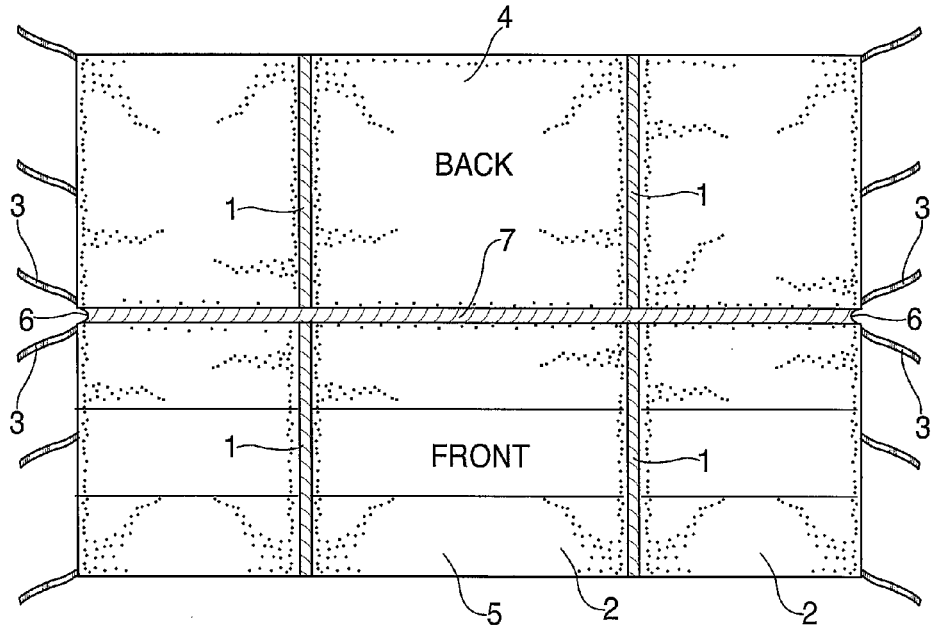
FIG. 2 is an alternate embodiment of the invention for a bed having bed posts.

In FIG. 2 an alternate embodiment of the invention is shown where the cover is applied to a bed with posts. Cut outs 6 for the posts are provided on each side of the cover. In a preferred embodiment the cut outs can be elasticized for a tighter fit.

The back and front panels are made of a material selected from the group consisting of cotton, hemp, faux suede, satin, leather, polyester, silk blended fabrics. Preferred materials are green organic renewable fabrics like cotton, hemp, silk and such blends.

The back and front panels each contain at least one cinch cord. In alternate embodiments multiple cinch cords can be used to create a tighter fit to the headboard.

The cinch cord used in the invention is essentially a hollow channel covering a pull cord. The channel once sewn into the panel will change the shape of the panel when the cord is pulled and the channel gathered. The channel is preferably made of a fabric that gathers nicely and does not bind. Cotton is a preferred fabric to use in the invention.

The cord also has to stay in the channel without pulling through or out of the channel and must be able to tolerate a good pull force without breaking (like shoe laces).

The back and front panels each contain one or more tie backs. Preferably, each panel contains three tie backs on each side which are then tied to secure the headboard or footboard cover to the frame.

The back and front panels range is size from 41 to 82 inches wide and 96 to 192 inches high and to fit king, California king, queen, full, single and day bed head and foot boards.

Typical width and height dimensions are for a California king 74×48 inches; king 78×48 inches; queen 62×48; full 56×48 and twin 41×48. A daybed equals one king and two twins. More particularly a day bed has a headboard on one side and two ends. The twin covers would fit the ends and the king cover would fit the side board.

The invention also includes covers for extra tall headboards and provides for extra tall version in each size from king to twin.

The top cinch cord in the invention cover is preferably 41 to 82 inches long.

The invention also provides a method for preparing an upholstered headboard and/or footboard cover for a bed comprising the steps of: providing a head or foot board made of wood, iron, leather or any other metal or plastic material; applying a cover on top of said head or foot board; wherein said cover is comprised of a back panel with at least one cinch cord and at least one tie back on each side of said back panel; a front panel with at least one cinch cord and at least one tie back on each side of said front panel; wherein said front panel has at least one pocket which may be filled with foam, feather, polyester or other like material; and a top panel; wherein said top cinch cord connects the back and front panels; tying said tie backs on said front panel to said tie backs on said back panel; and pulling said cinch cord on said front panel and said back panel to conform to the head or foot board and to fit snuggly thereon.

The foregoing description of various and preferred embodiments of the present invention has been provided for purposes of illustration only, and it is understood that numerous modifications, variations and alterations may be made without departing from the scope and spirit of the invention as set forth in the following claims.

What is claimed is:

1. A headboard or footboard cover for a bed comprised of
a back panel with at least one cinch cord and at least one tie back on each side of said back panel;
a front panel with at least one cinch cord and at least one tie back on each side of said front panel; wherein said front panel has at least one pocket filled with a filler material selected from the group consisting of foam, feather, polyester and other like material; and
a top cinch cord; wherein said top cinch cord connects the back and front panels.

2. The headboard or footboard cover according to claim 1, wherein said
back, front and top panels are made of a material selected from the group consisting of cotton, hemp, faux suede, leather, satin, polyester, silk blended fabrics.

3. The headboard or footboard cover according to claim 1, wherein said back and front panels each contain one of more cinch cords.

4. The headboard or footboard cover according to claim 1, wherein said back panel contain one or more tie backs.

5. The headboard or footboard cover according to claim 1, wherein said front panel contain one or more tie backs.

6. The headboard or footboard cover according to claim 1, wherein the back and front panels are sizes which fit king, California king, queen, full, single or day bed head and foot boards.

7. The head or footboard cover according to claim 1, wherein said back and front panels range from 41 to 82 inches wide and 96 to 192 inches high.

8. The headboard or footboard cover according to claim 1, wherein said top cinch cord is 41 to 82 inches long.

9. A method for preparing an upholstered headboard or footboard cover for a bed comprising the steps of:

providing a head or foot board made of wood, iron, leather, brass, steel, aluminum, plastic, metal or composite;

applying a cover on top of said head or foot board; wherein said cover is comprised of a back panel with at least one cinch cord and at least one tie back on each side of said back panel; a front panel with at least one cinch cord and at least one tie back on each side of said front panel; and a top cinch cord to connect said back and front panels;

wherein said front panel has at least one pocket filled with a filler material selected from the group consisting of foam, feather, polyester and other like material;

tying said tie backs on said front panel to said tie backs on said back panel; and pulling said cinch cord on said front panel and said back panel to conform to the head or foot board and to fit snuggly thereon.

10. The method according to claim 9, wherein said top cinch cord is pulled to further conform to the head or foot board and to fit snuggly thereon.

* * * * *